US008839991B2

(12) United States Patent
Smernoff

(10) Patent No.: US 8,839,991 B2
(45) Date of Patent: Sep. 23, 2014

(54) DISPENSING BOTTLE FOR LIQUID SOLUTIONS

(76) Inventor: Ronald B. Smernoff, Burlingame, CA (US)

( * ) Notice: Subject to any disclaimer, the term of this patent is extended or adjusted under 35 U.S.C. 154(b) by 239 days.

(21) Appl. No.: 11/759,176

(22) Filed: Jun. 6, 2007

(65) Prior Publication Data

US 2008/0302829 A1 Dec. 11, 2008

(51) Int. Cl.
*B67D 7/76* (2010.01)
*B05B 11/00* (2006.01)

(52) U.S. Cl.
CPC ..... *B05B 11/0016* (2013.01); *B05B 11/0021* (2013.01); *B05B 11/3057* (2013.01)
USPC ..... 222/189.09; 222/382; 222/383.1

(58) Field of Classification Search
CPC ..... B05B 11/0021; B05B 11/0016; B05B 11/3057; B65D 51/1616
USPC ..... 222/189.06, 189.09, 189.1, 189.11, 222/382, 383.1
See application file for complete search history.

(56) References Cited

U.S. PATENT DOCUMENTS

| | | | | |
|---|---|---|---|---|
| 4,072,252 | A | 2/1978 | Steyns et al. | |
| 4,161,288 | A | 7/1979 | McKinney | |
| 4,192,919 | A | 3/1980 | Raghavachari | |
| 4,935,371 | A * | 6/1990 | Rickloff | 435/304.3 |
| 4,938,389 | A * | 7/1990 | Rossi et al. | 222/189.08 |
| 5,150,841 | A | 9/1992 | Silvenis et al. | |
| 5,244,126 | A * | 9/1993 | Geier | 222/383.1 |
| 5,752,629 | A * | 5/1998 | Hardy | 222/189.09 |
| 5,971,221 | A * | 10/1999 | Schwarz | 222/189.09 |
| 5,988,454 | A | 11/1999 | Ellion | |
| 6,073,812 | A * | 6/2000 | Wade et al. | 222/189.09 |
| 6,196,409 | B1 * | 3/2001 | Lake et al. | 220/371 |
| 6,234,412 | B1 * | 5/2001 | von Schuckmann | 239/333 |
| 6,257,455 | B1 * | 7/2001 | Trepina et al. | 222/189.09 |
| 6,502,766 | B1 | 1/2003 | Streutker et al. | |
| 6,708,850 | B2 | 3/2004 | Uetake et al. | |
| 6,715,772 | B1 * | 4/2004 | Micciche et al. | 277/650 |
| 6,942,124 | B2 * | 9/2005 | Dehn et al. | 222/189.09 |
| 2006/0180613 | A1 * | 8/2006 | Manesis | 222/189.09 |

* cited by examiner

*Primary Examiner* — Daniel R Shearer
(74) *Attorney, Agent, or Firm* — Fulwider Patton LLP

(57) ABSTRACT

The dispensing bottle includes a dispensing head with an air inlet allowing ambient air to enter an opening of a reservoir portion of the bottle, and a filter member that fits over and seals the opening of the reservoir portion of the bottle for filtering the ambient air entering the bottle to prevent contaminants from entering the reservoir portion of the bottle along with ambient air.

15 Claims, 3 Drawing Sheets

DISPENSING BOTTLE FOR LIQUID SOLUTIONS

BACKGROUND OF THE INVENTION

Sterile spray or squirt bottles are commonly used to dispense decontaminating and disinfecting liquids, such as a sterile 70% isopropyl alcohol solution, for example, for maintaining controlled environments, such as in pharmacology and manufacturing. Referring to FIG. 1, a prior art hand operated trigger spray bottle 10 containing such liquids is typically supplied packaged in double or triple sealed bags 12, and may also be irradiated such as with gamma radiation to at least initially ensure that the bottle and contents are sterile and pyrogen free according to industry standards. Referring to FIG. 2, the dispensing head 14 of a conventional hand operated trigger sprayer typically includes a vent passage 16 in the housing 18 of the pump of the sprayer which communicates through the connection of the dispensing head with the reservoir portion 20 of the bottle with the interior of the reservoir portion to allow venting of the interior of the reservoir portion of the sprayer. A piston 22 which is reciprocated in a chamber 24 in the housing typically has a seal associated with the vent passage so that vacuum development in the container is avoided when the sprayer is used. However, when a liquid is dispensed from the sprayer, the spray container typically refills through the vent with ambient air that can contain contaminants, so that after the bottle is used, the bottle and its contents can no longer be guaranteed to be sterile and free from pyrogens to meet industry standards.

Another similar type of conventional hand operated trigger sprayer includes an air inlet unit that prevents the spray bottle from leaking contents of the bottle through the air inlet vent port during operation. However, ambient air entering the spray bottle is not filtered, and can permit contaminants to enter the spray bottle along with ambient air during use. A liquid sprayer is also known that includes a bottle having an opening and a sprayer housing attached to the bottle with a venting mechanism. Although a dip tube filter can be added at the lower end of a dip tube to prevent particles from obstructing the nozzle, ambient air entering the sprayer is not filtered, allowing contaminants to enter the sprayer during use.

A squeeze bottle for use as an eyedropper is also known that includes a discharge port with a filter to prevent ambient air and bacteria from entering a liquid content of the container so as to keep it sterilized even after unsealed for use. A discharging passage is formed in the stopper of the bottle, and the stopper further has a check valve and a filter disposed on the discharge port on the downstream side of the valve. The bottle is formed with an outer layer and an inner layer delaminating from the outer layer, and a vent hole is formed in the outer layer so as to introduce ambient air in between outer and inner layers of the container, but ambient air entering the bottle through the vent is not filtered, allowing contaminants to enter through the vent.

It would thus be desirable to provide a bottle for dispensing a sterile liquid with a filter member that seals the opening of the reservoir portion of the bottle for filtering ambient air entering through a vent of the bottle to prevent contaminants from entering along with ambient air through the vent of the bottle. The present invention meets these and other needs.

SUMMARY OF THE INVENTION

Briefly, and in general terms, the present invention provides for a bottle for dispensing a sterile liquid, the bottle including a dispensing head with an air inlet allowing ambient air to enter the opening of a reservoir portion of the bottle, and a filter member that fits over and seals the opening of the reservoir portion of the bottle for filtering the ambient air entering the bottle to prevent contaminants from entering the reservoir portion of the bottle along with ambient air.

The present invention accordingly provides for a bottle for dispensing a sterile liquid, the bottle including a reservoir portion having an interior chamber and an opening to the interior chamber, and a dispensing head that attaches to the opening of the reservoir portion. The dispensing head includes a liquid outlet port for dispensing the sterile liquid from the bottle, a dip tube received in the interior chamber of the reservoir portion, and an air inlet port allowing ambient air to enter the opening of the reservoir portion after liquid is dispensed from the bottle. A filter member, such as a filter disk, for example, fits over and seals the opening of the reservoir portion of the bottle. The filter member includes a dip tube hole for receiving and sealing around the dip tube, and one or more vent holes covered on at least one side of the filter member by a membrane filter for filtering ambient air. The dip tube hole forms a tight interference fit with the dip tube when the dip tube is received in the dip tube hole, to form a tight seal around the dip tube. In a presently preferred aspect, the membrane filter is formed from a porous polymeric sheet material with pores having a diameter less than 220 nm. In another presently preferred aspect, the membrane filter is formed from a porous polymeric sheet material with pores having a diameter of about 100 nm. In another aspect, the membrane filter is formed from a porous polymeric sheet material such as polyether sulfone or polypropylene. In another presently preferred aspect, the filter member is formed from plastic, such as polyethylene, for example, and the filter member may be attached to the opening of the bottle.

These and other aspects and advantages of the invention will become apparent from the following detailed description and the accompanying drawings, which illustrate by way of example the features of the invention.

DETAILED DESCRIPTION OF THE PREFERRED EMBODIMENTS

Figure 1:
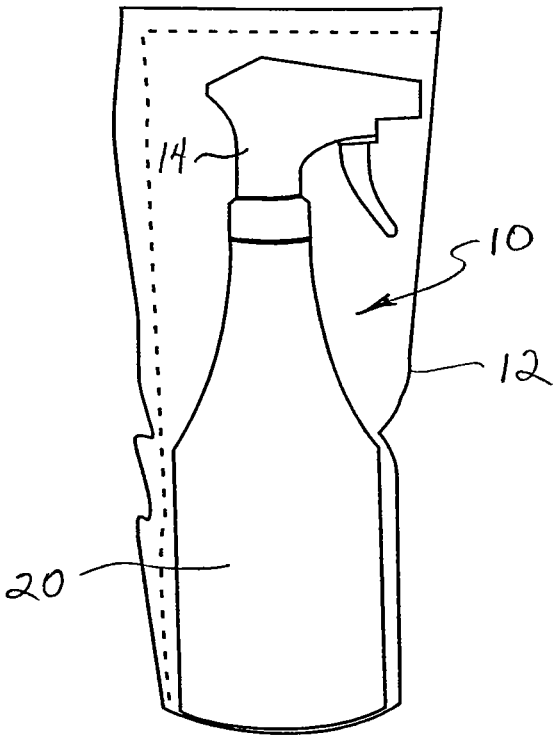
FIG. 1 PRIOR ART
FIG. 1 is a side view of a prior art bottle for dispensing a sterile liquid.
Figure 2:
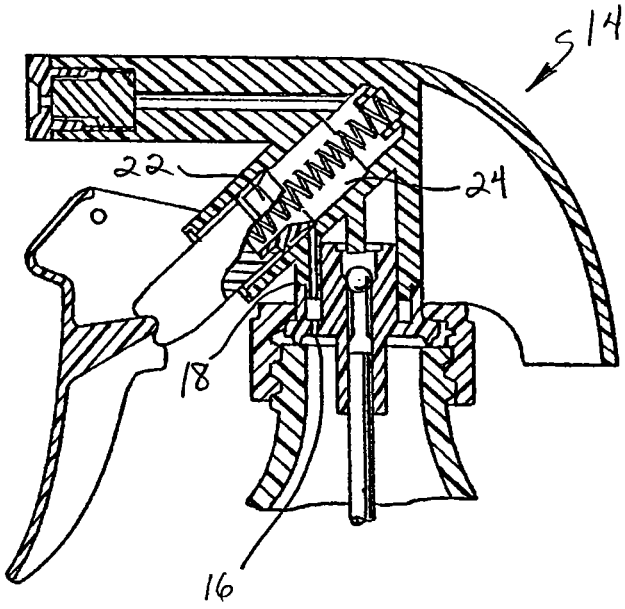
FIG. 2 PRIOR ART
FIG. 2 is a sectional view of a dispensing head of a prior art hand operated trigger sprayer.
Figure 3:
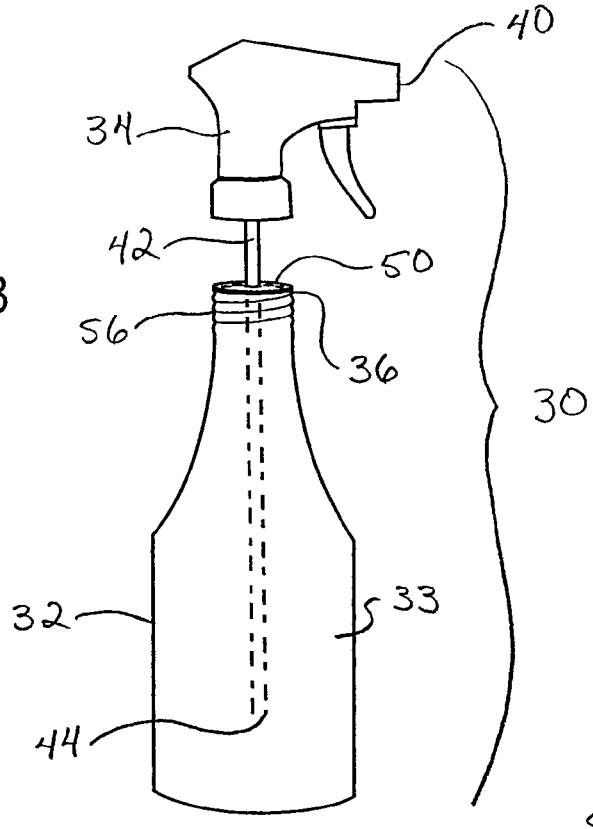
FIG. 3 is a side view of a bottle for dispensing a sterile liquid with the dispensing head shown partially removed from the bottle reservoir portion to show the position of the filter member according to the present invention.
Figure 4:
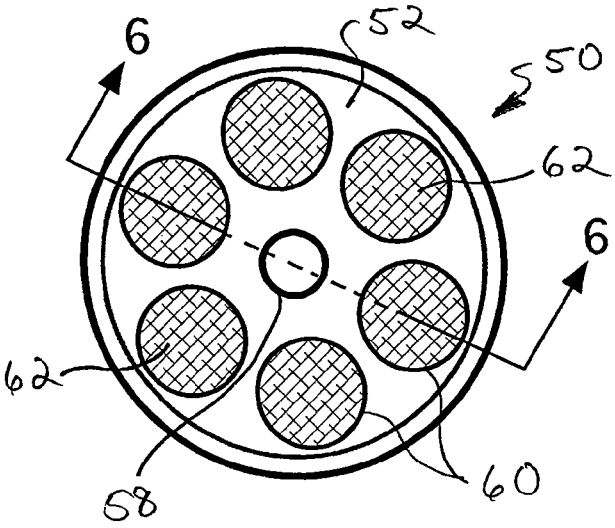
FIG. 4 is a bottom plan view of a first version of a filter member for a bottle for dispensing a sterile liquid of FIG. 3 according to the present invention.
Figure 5:
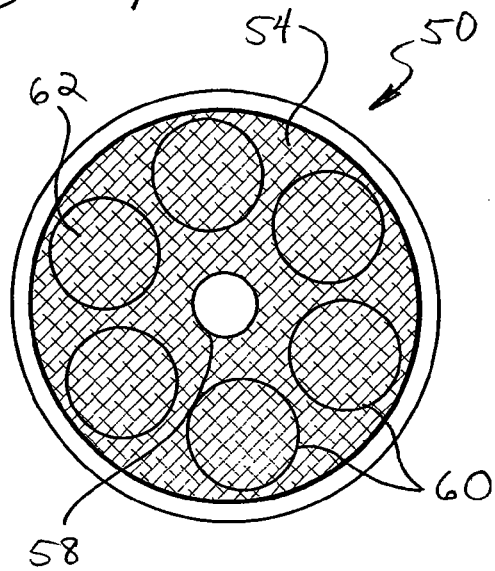
FIG. 5 is a top plan view of the filter member of FIG. 4.
Figure 6:
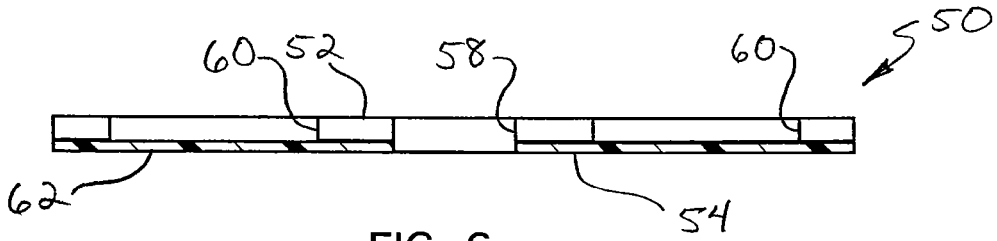
FIG. 6 is a sectional view taken along line 6-6 of FIG. 4 showing a membrane filter on one side of the filter member.

Referring to the drawings, which are provided by way of example, and not by way of limitation, the present invention provides for a bottle 30 for dispensing a sterile liquid. The sterile liquid may be a decontaminating or disinfecting liquid, such as a sterile 70% isopropyl alcohol solution, for example, typically for use in pharmacology or manufacturing for maintaining controlled environments, for example. The bottle includes a container or reservoir portion 32 with an interior chamber 33, a dispensing head 34, such as a trigger-type pump sprayer, for example, that attaches to a mouth or opening 36 of the reservoir portion. The dispensing head typically includes a liquid outlet port 40 for dispensing the liquid from the bottle and a dip tube 42 with a liquid inlet port 44 connected in fluid communication with the liquid outlet port, as will be further explained below. As described in connection with FIG. 2, the dispensing head typically includes an air inlet port 16 for allowing ambient air to enter the reservoir portion of the bottle to equalize pressure in the reservoir portion when liquid is dispensed from the bottle.

Referring to FIGS. 3-9, a filter member 50, such as a filter disk, for example, having generally flat top and bottom sides 52, 54, is disposed between the dispensing head and the reservoir portion of the bottle, and fits over and seals the mouth or opening of the bottle. The mouth of the reservoir portion typically is formed with external threads 56 for receiving corresponding internal threads (not shown) of the lower portion of the dispensing head for sealing the dispensing head tightly to the mouth of the reservoir portion of the bottle, and the filter member can seal the mouth of the reservoir portion when it is clamped between the dispensing head and the mouth of the reservoir portion in this manner. Alternatively, the filter member can be affixed to the mouth or opening of the reservoir portion of the bottle, such as by adhesive or by heat sealing, for example.

Figure 7:
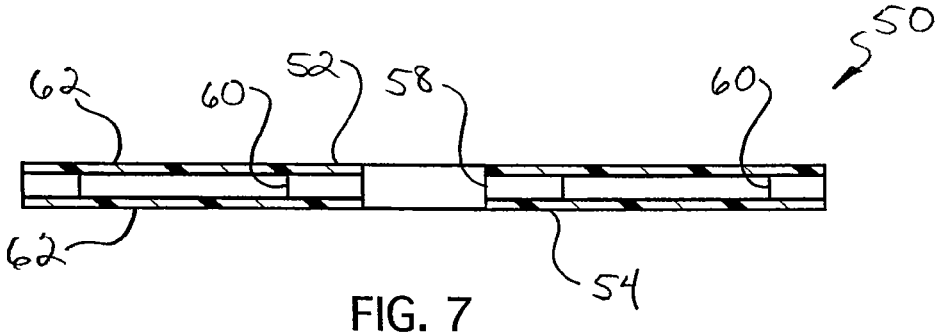
FIG. 7 is a sectional view similar to FIG. 6 showing a variation of the filter member with a membrane filter on both sides of the filter member.
Figure 8:
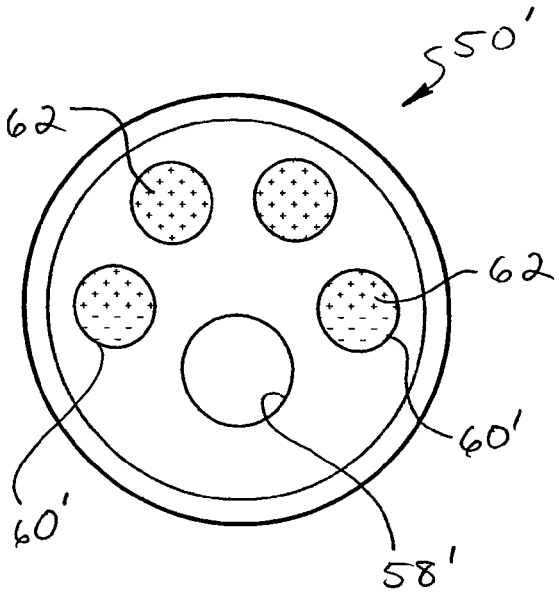
FIG. 8 is a bottom plan view of a second version of a filter member for a bottle for dispensing a sterile liquid of FIG. 3 according to the present invention.
Figure 9:
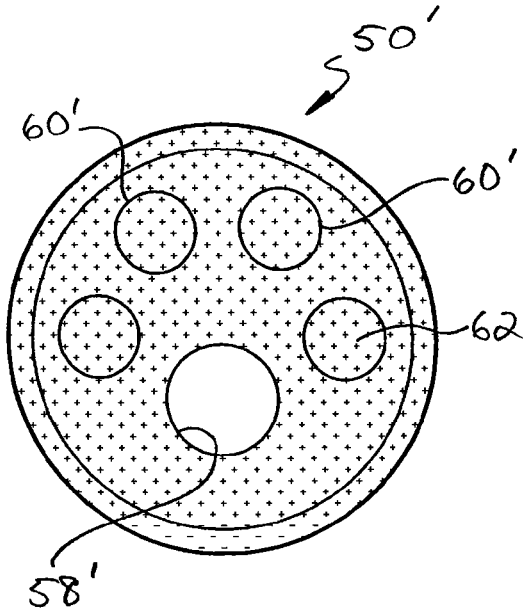
FIG. 9 is a top plan view of the filter member of FIG. 8.

Referring to FIGS. 4-9, the filter member includes a dip tube hole 58 for receiving the dip tube, which receives and seals around the dip tube. The dip tube hole extends through the filter member between the top and bottom sides of the filter member, and is sized appropriately to form a tight interference fit with the dip tube to seal around the dip tube when it is inserted through the dip tube hole. The filter member also advantageously includes one or more vent holes 60, such as four to six vent holes, for example, that extend through the filter member between the top and bottom sides of the filter member as is illustrated in FIGS. 4-9. Referring to FIGS. 4-7, in one presently preferred embodiment, the filter member includes six vent holes uniformly arrayed around a central dip tube hole. Alternatively, in one presently preferred variation, the filter member 50' may include four vent holes 60' and an off-center dip tube hole 58', appropriately spaced and sized to accommodate a corresponding dip tube of a dispensing head. The filter member can be formed of plastic, such as from a polymeric material such as polyethylene, for example. The one or more vent holes are covered by a membrane filter 62 for filtering ambient air, and as is illustrated in FIGS. 4-6 and 8-9, the membrane filter is affixed to at least one side of the filter member. As shown in FIG. 7, a membrane filter may be affixed to both sides of the filter member. The membrane filter is preferably formed from a porous polymeric sheet material with pores having a diameter less than 220 nm, in order to allow the filter member to filter contaminants to allow the dispensing bottle to ensure that the bottle and contents can be maintained sterile and pyrogen free according to industry standards. In a presently preferred aspect, the membrane filter is formed from a porous polymeric sheet material with pores having a diameter of about 100 nm. The porous polymeric sheet material can be polyether sulfone or polypropylene, although other similar polymeric materials may also be suitable. The one or more vent holes are typically formed in the plastic filter member first, and the membrane filter is then affixed to at least one side of the disk, such as by adhesive or by heat sealing, for example, to cover the one or more vent holes. The dip tube hole is then drilled through the one or more membrane filters and the plastic disk, and a correspondingly dimensioned dip tube of a dispensing head for the bottle can then be inserted through the dip tube hole.

It will be apparent from the foregoing that while particular forms of the invention have been illustrated and described, various modifications can be made without departing from the spirit and scope of the invention. Accordingly, it is not intended that the invention be limited, except as by the appended claims.

The invention claimed is:

1. A bottle for dispensing a sterile liquid, comprising:

a reservoir portion having an interior chamber and a mouth opening to the interior chamber;

a filter disk affixed to the mouth opening of the reservoir portion of the bottle to seal the mouth opening of the reservoir portion of the bottle, the filter disk having two planar sides, and a plurality of vent holes therethrough, and a filter disk dip tube hole formed through said filter disk, said filter disk dip tube hole being disposed off-center in said filter disk displaced to one side of a center of said filter disk, and said plurality of vent holes being disposed in said filter disk displaced to an opposing side of the center of the filter disk;

a dispensing head that attaches to the mouth opening of the reservoir portion over said filter disk, the dispensing head having a liquid outlet port for dispensing the sterile liquid from the bottle, an air inlet port for allowing ambient air to enter the mouth opening of the reservoir portion through said plurality of vent holes of said filter disk to equalize pressure in the bottle reservoir after liquid is dispensed from the bottle, and a dip tube configured to be inserted through and received through said filter disk dip tube hole formed through said filter disk, and received in the interior chamber of the reservoir portion, the dip tube including a liquid inlet port connected in fluid communication with the liquid outlet port, said filter disk dip tube hole formed through said filter disk sealing around the dip tube, and said filter disk dip tube hole being configured to form a tight interference fit with the dip tube to seal around the dip tube; and first and second porous membrane filters affixed to both sides of said filter disk by adhesive, said first and second porous membrane filters covering said plurality of vent holes of said filter disk on both of said two planar sides of said filter disk, each of said first and second porous membrane filters including membrane filter dip tube holes formed through said first and second porous membrane filters and aligned with each other and said filter disk dip tube hole, respectively, said membrane filter dip tube holes being configured to form a tight interference fit with the dip tube to seal around the dip tube, one of said first and second porous membrane filters being affixed between the mouth opening of the reservoir portion of the bottle and said filter disk and fixedly sealing the mouth opening of the reservoir portion of the bottle, said first and second porous membrane filters being configured to filter ambient air entering the bottle to prevent contaminants from entering the reservoir portion of the bottle along with the ambient air.

2. The bottle of claim 1, wherein said first and second porous membrane filters are formed from a porous polymeric sheet material with pores having a diameter less than 220 nm.

3. The bottle of claim 1, wherein said first and second porous membrane filters are formed from a porous polymeric sheet material with pores having a diameter of about 100 nm.

4. The bottle of claim 1, wherein said filter disk is formed from plastic.

5. The bottle of claim 4, wherein said filter disk is formed from polyethylene.

6. The bottle of claim 1, wherein said first and second porous membrane filters are formed from polyether sulfone.

7. The bottle of claim 1, wherein said first and second porous membrane filters are formed from polypropylene.

8. A bottle for dispensing a sterile liquid, comprising:

a reservoir portion having an interior chamber and a mouth opening to the interior chamber;

a dispensing head that attaches to the mouth opening of the reservoir portion, the dispensing head having a liquid outlet port for dispensing the sterile liquid from the bottle, a dip tube received in the interior chamber of the reservoir portion, the dip tube including a liquid inlet port connected in fluid communication with the liquid outlet port, and an air inlet port for allowing ambient air to enter the mouth opening of the reservoir portion to equalize pressure in the bottle reservoir after liquid is dispensed from the bottle;

a filter disk affixed to the mouth opening of the reservoir portion of the bottle to seal the mouth opening of the reservoir portion of the bottle, the filter disk having two planar sides and a plurality of vent holes therethrough configured to allow ambient air to enter through the mouth of the opening of the reservoir, and a filter disk dip tube hole formed through said filter disk, said filter disk dip tube hole being disposed off-center in said filter disk displaced to one side of a center of said filter disk, and said plurality of vent holes being disposed in said filter disk displaced to an opposing side of the center of the filter disk, said dip tube being configured to be inserted through and received through said filter disk dip tube hole formed through said filter disk, and wherein said filter disk dip tube hole formed through said filter disk is configured to form a tight interference fit with the dip tube to seal around the dip tube; and first and second porous membrane filters affixed to both sides of said filter disk by heat sealing, said first and second porous membrane filters covering said plurality of vent holes of said filter disk on both of said two planar sides of said filter disk, said first and second porous membrane filters being formed from a porous polymeric sheet material with pores having a diameter less than 220 nm, each of said first and second porous membrane filters including membrane filter dip tube holes formed through said first and second porous membrane filters and aligned with each other and said filter disk dip tube hole, respectively, said membrane filter dip tube holes being configured to form a tight interference fit with the dip tube to seal around the dip tube, one of said first and second porous membrane filters being affixed between the mouth opening of the reservoir portion of the bottle and said filter disk and fixedly sealing the mouth opening of the reservoir portion of the bottle, said first and second porous membrane filters being configured to filter ambient air entering the bottle to prevent contaminants from entering the reservoir portion of the bottle along with the ambient air.

9. The bottle of claim 8, wherein said first and second porous membrane filters are formed from a porous polymeric sheet material with pores having a diameter of about 100 nm.

10. The bottle of claim 8, wherein said filter disk is formed from plastic.

11. The bottle of claim 10, wherein said filter disk is formed from polyethylene.

12. The bottle of claim 8, wherein said first and second porous membrane filters are formed from polyether sulfone.

13. The bottle of claim 8, wherein said first and second porous membrane filters are formed from polypropylene.

14. A bottle for dispensing a sterile liquid, comprising:

a reservoir portion having an interior chamber and a mouth opening to the interior chamber;

a dispensing head that attaches to the mouth opening of the reservoir portion, the dispensing head having a liquid outlet port for dispensing the sterile liquid from the bottle, a dip tube received in the interior chamber of the reservoir portion, the dip tube including a liquid inlet port connected in fluid communication with the liquid outlet port, and an air inlet port for allowing ambient air to enter the mouth opening of the reservoir portion to equalize pressure in the bottle reservoir after liquid is dispensed from the bottle; and a filter disk bonded to and sealing the mouth opening of the reservoir portion of the bottle, the filter disk having two planar sides, a plurality of vent holes therethrough configured to allow ambient air to enter through the mouth of the opening of the reservoir, and a filter disk dip tube hole formed through said filter disk, said filter disk dip tube hole being disposed off-center in said filter disk displaced to one side of a center of said filter disk, and said plurality of vent holes being disposed in said filter disk displaced to an opposing side of the center of the filter disk, said dip tube being configured to be inserted through and received through said filter disk dip tube hole formed through said filter disk, and said filter disk dip tube hole formed through said filter disk sealing around the dip tube; and first and second porous membrane filters bonded to both sides of said filter disk, said first and second porous membrane filters covering said plurality of vent holes of said filter disk on both of said two planar sides of said filter disk, said first and second porous membrane filters being formed from a porous polymeric sheet material with pores having a diameter of about 100 nm, each of said first and second porous membrane filters including membrane filter dip tube holes formed through said first and second porous membrane filters and aligned with each other and said filter disk dip tube hole, respectively, said membrane filter dip tube holes being configured to form a tight interference fit with the dip tube to seal around the dip tube, one of said first and second porous membrane filters being bonded between the mouth opening of the reservoir portion of the bottle and said filter disk fixedly sealing the mouth opening of the reservoir portion of the bottle, said first and second porous membrane filters being configured to filter ambient air entering the bottle to prevent contaminants from entering the reservoir portion of the bottle along with the ambient air.

15. The bottle of claim 14, wherein said filter disk dip tube hole of said filter disk is configured to form a tight interference fit with the dip tube to seal around the dip tube.

* * * * *